US009407006B1

(12) United States Patent
Wilson et al.

(10) Patent No.: US 9,407,006 B1
(45) Date of Patent: Aug. 2, 2016

(54) CHOKE FOR ANTENNA

(71) Applicant: NEPTUNE TECHNOLOGY GROUP INC., Tallassee, AL (US)

(72) Inventors: Michael A Wilson, Tallassee, AL (US); Damon Lloyd Patton, Tallassee, AL (US)

(73) Assignee: Neptune Technology Group Inc., Tallassee, AL (US)

( * ) Notice: Subject to any disclaimer, the term of this patent is extended or adjusted under 35 U.S.C. 154(b) by 0 days.

(21) Appl. No.: 14/600,950

(22) Filed: Jan. 20, 2015

Related U.S. Application Data

(63) Continuation of application No. 13/842,674, filed on Mar. 15, 2013, now Pat. No. 8,994,594.

(51) Int. Cl.

| | |
|---|---|
| ***H01Q 1/04*** | (2006.01) |
| ***H01Q 1/52*** | (2006.01) |
| ***H01Q 1/22*** | (2006.01) |
| ***H01Q 1/50*** | (2006.01) |
| ***H01Q 9/04*** | (2006.01) |

(52) U.S. Cl.
CPC ..... *H01Q 1/526* (2013.01); *H01Q 1/04* (2013.01); *H01Q 1/2233* (2013.01); *H01Q 1/50* (2013.01); *H01Q 9/0407* (2013.01); *H01Q 9/0464* (2013.01)

(58) Field of Classification Search
CPC ..... H01Q 1/04; H01Q 9/04; H01Q 9/0407; H01Q 9/0464
USPC ..... 343/719, 700 MS, 791
See application file for complete search history.

(56) References Cited

U.S. PATENT DOCUMENTS

| | | | | |
|---|---|---|---|---|
| 4,382,260 | A | 5/1983 | Ranghelli | |
| 4,414,550 | A | 11/1983 | Tresselt | |
| 4,509,056 | A * | 4/1985 | Ploussios | H01Q 9/16 343/791 |
| 4,511,900 | A | 4/1985 | Deasy | |
| 4,525,720 | A | 6/1985 | Corzine | |
| 4,825,222 | A | 4/1989 | Butcher | |
| 4,987,421 | A | 1/1991 | Sunahara | |
| 5,099,249 | A | 3/1992 | Seavey | |
| 5,440,317 | A * | 8/1995 | Jalloul | H01Q 1/084 343/702 |
| 5,621,422 | A | 4/1997 | Wang | |
| 5,652,598 | A * | 7/1997 | Campbell et al. | 343/791 |
| 6,040,805 | A * | 3/2000 | Huynh et al. | 343/785 |
| 6,054,953 | A | 4/2000 | Lindmark | |

(Continued)

FOREIGN PATENT DOCUMENTS

| | | |
|---|---|---|
| CN | 101127415 | 2/2008 |
| EP | 490760 | 6/1992 |
| JP | 2000077930 | 3/2000 |

*Primary Examiner* — Hoang V Nguyen
(74) *Attorney, Agent, or Firm* — Paul Sykes; Angela Holt; Bradley Arant Boult Cummings LLP

(57) ABSTRACT

An antenna having a radiator comprising a conduct in a closed path driven by a plurality of microstrips connecting the radiator to a common, single feed and to a ground plane, with the radiator lying in a plane parallel to that of the ground plane. The radiator may be annular, with the feed located in its center. The relative location of the feed on the microstrips allows a lower input impedance to be leveraged to match a higher load impedance of the radiator. A single-ended input drives all points of the radiator substantially in phase. In another embodiment, the antenna comprises a cylindrical choke one-quarter wavelength in length placed around the coax feed and connected to the underside of the ground plane.

20 Claims, 9 Drawing Sheets

(56) References Cited

U.S. PATENT DOCUMENTS

| | | | | |
|---|---|---|---|---|
| 6,133,878 | A | 10/2000 | Lee | |
| 6,377,226 | B1 * | 4/2002 | Ha | H01Q 1/242 343/791 |
| 6,414,605 | B1 * | 7/2002 | Walden et al. | 340/870.02 |
| 6,597,316 | B2 | 7/2003 | Rao | |
| 6,812,902 | B2 | 11/2004 | Rossman | |
| 6,836,247 | B2 | 12/2004 | Soutiaguine et al. | |
| 6,876,327 | B2 | 4/2005 | Collins | |
| 6,956,529 | B1 | 10/2005 | Chen | |
| 7,170,463 | B1 | 1/2007 | Seavey | |
| 7,190,310 | B2 | 3/2007 | Masutani | |
| 7,511,669 | B2 | 3/2009 | Maeda | |
| 8,193,989 | B2 | 6/2012 | Fujita | |
| 8,743,005 | B2 | 6/2014 | Stuart | |
| 2008/0024382 | A1 | 1/2008 | Uddin et al. | |
| 2008/0158066 | A1 | 7/2008 | Yu | |
| 2010/0085264 | A1 | 4/2010 | Du | |
| 2010/0315293 | A1 | 12/2010 | Lehtola et al. | |
| 2011/0115676 | A1 | 5/2011 | Tatarnikov et al. | |
| 2013/0278473 | A1 | 10/2013 | Bowers | |

* cited by examiner

CHOKE FOR ANTENNA

PRIORITY CLAIM

This application is a continuation under 35 U.S.C. §120 of U.S. application Ser. No. 13/842,674, and claims priority thereto and the benefit thereof.

TECHNICAL FIELD

The invention relates generally to the field of electromagnetic propagation, and more particularly to antennas.

BACKGROUND

Antennas are used in a variety of applications for transmission and receipt of information via electromagnetic waves. The direction at which an antenna radiates or receives power can be optimized by the shape and structure of the antenna, as well as the method of driving it. In some applications, a highly directional antenna is desired, while in others an omnidirectional antenna is desired. In the transmission mode, an input signal connects to a feed on the antenna and drives a radiator. The electrical signal of the input is converted to electromagnetic radiation that propagates from the radiator in accordance with its directivity. The process basically works in reverse when an antenna is receiving a signal.

In addition, for maximum efficiency, the load presented by the antenna itself, or more specifically, by the radiator of the antenna, should be matched to the input impedance of the feed. This minimizes loss due to reflections and standing waves created by impedance mismatching.

Space considerations also play a role in antenna design. For example, an elongated antenna (such as a traditional dipole) may provide an ideal power distribution pattern for a given application; however, the device or product of which the antenna is a part, or the application in which the antenna is used, may not permit the use of a long, somewhat fragile antenna such as a traditional dipole.

For terrestrially based applications, in which the device receiving signals from or transmitting to an antenna is positioned away from the antenna at relatively small angle from horizontal, it is desirable that the antenna's power distribution be directed primarily outward (or horizontally), rather than vertically. A traditional dipole antenna provides such a radiation pattern but often proves too large or fragile for a given application. One use of antennas includes transmitting from a location located at or near ground level to receivers located on power or telephone poles, or buildings, which may be located in any direction from the antenna. In such locations, the size of the antenna is a key consideration, as well as the likelihood that the antenna will inevitably come into contact with persons or objects.

When a dipole, ring, yagi, or similar type antenna is fed with a coax connection, the coaxial cable may act as a radiator, in addition to the radiator of the antenna itself. To isolate the antenna radiator from the coax feed cable, and prevent coax cable from radiating, a choke balun may be added between the antenna and the feed line. This is prior art. These types of antennas, however, do not have a ground plane. Some circular antennas include a ground plane having concentric circular grooves formed in it, effectively leaving a series of concentric circular walls. In these devices, the choke is "above" the ground plane, with respect to the feed line.

For antennas with a radiator positioned over a ground plane, such as a patch antenna, prior art designs assume that that the ground plane isolates the radiator from the feed line (which is connected from below the ground plane), such that the feed line does not affect or interfere with the radiation pattern of the antenna. It has been discovered, however, that the ground plane does not provide adequate isolation and a coaxial feed cable can interfere with radiation patterns of antenna, even where the antenna radiator is separated from the coaxial cable by the ground plane.

Thus, there is a need for a relatively compact antenna that provides a substantially omnidirectional power distribution oriented primarily horizontally, rather than vertically. There is also a need for an antenna that is structurally resistant to bumps and knocks that may be experienced in a terrestrial installation. There is also a need for further isolating the radiation patterns of an antenna in which the radiator is separated from a feed, such as coaxial feed line, by a ground plane.

SUMMARY

Embodiments of the present invention satisfy these needs. One embodiment is an antenna comprising an annular radiator, a ground plane, a feed located in the center of said radiator, a plurality of radial microstrips, each microstrip having an inner end and an outer end, each outer end coupled to the radiator, each inner end coupled to the ground plane, where each microstrip is coupled to the feed between its inner and outer ends. The antenna has a resonant frequency defining a wavelength, and, in one embodiment, the outer end of each of the plurality of microstrips is coupled to the radiator within about one-fourth wavelength of the outer end of an adjacent one of the microstrips. The radiator has a load impedance and the feed has an input impedance, and, in another embodiment of the antenna, the ratio of the input impedance to the load impedance is a function of the ratio of the length of each microstrip from its first end to the feed, to the length of each microstrip from its first end to its second end. Another embodiment of the invention comprises an antenna having a radiator over a ground plane fed by a coaxial feed, in which a cylindrical choke approximately one-quarter wavelength in length is placed around the feed and connected to the underside of the ground plane.

BRIEF DESCRIPTION OF THE DRAWINGS

The present invention will be explained, by way of example only, with reference to certain embodiments and the attached Figures, in which.

DETAILED DESCRIPTION

Figure 1:
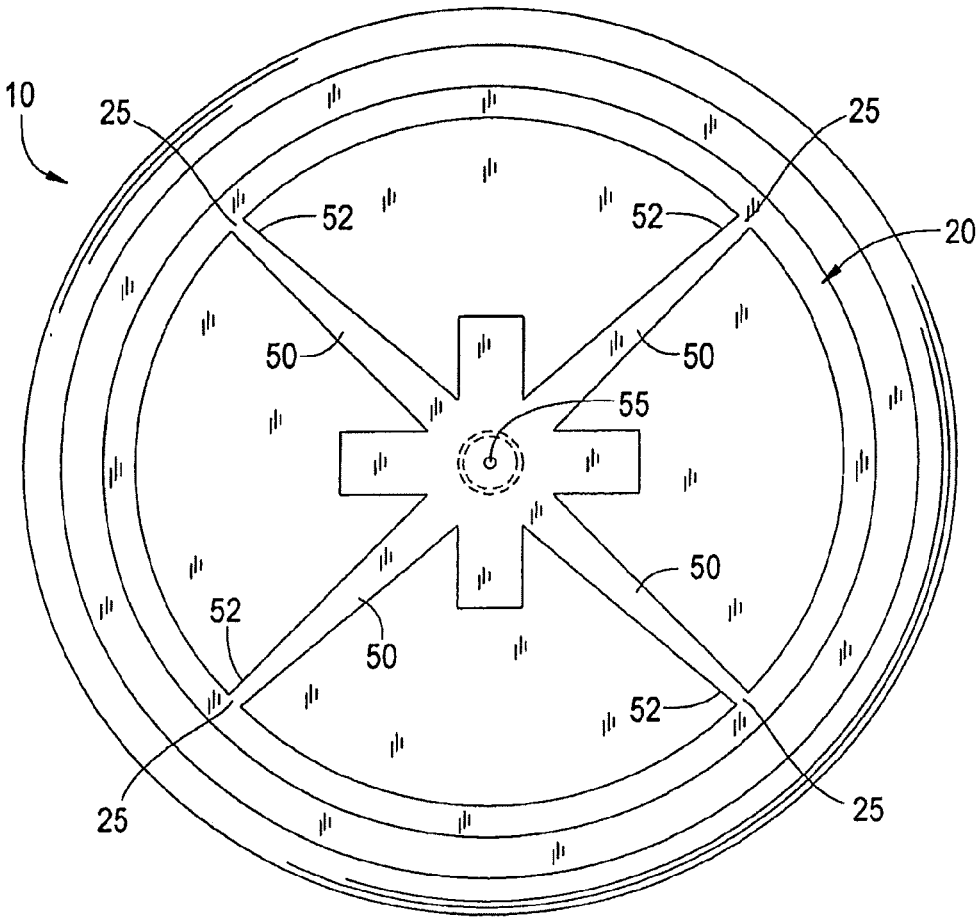
FIG. 1 is a top view of one embodiment of the present invention.
Figure 2:
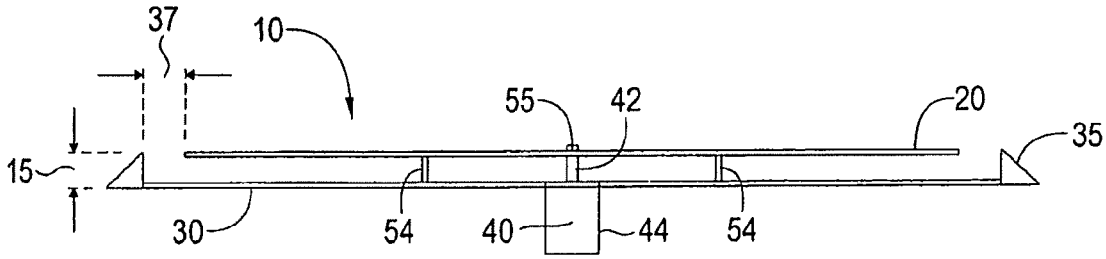
FIG. 2 is a side view of the embodiment of FIG. 1.
Figure 3:
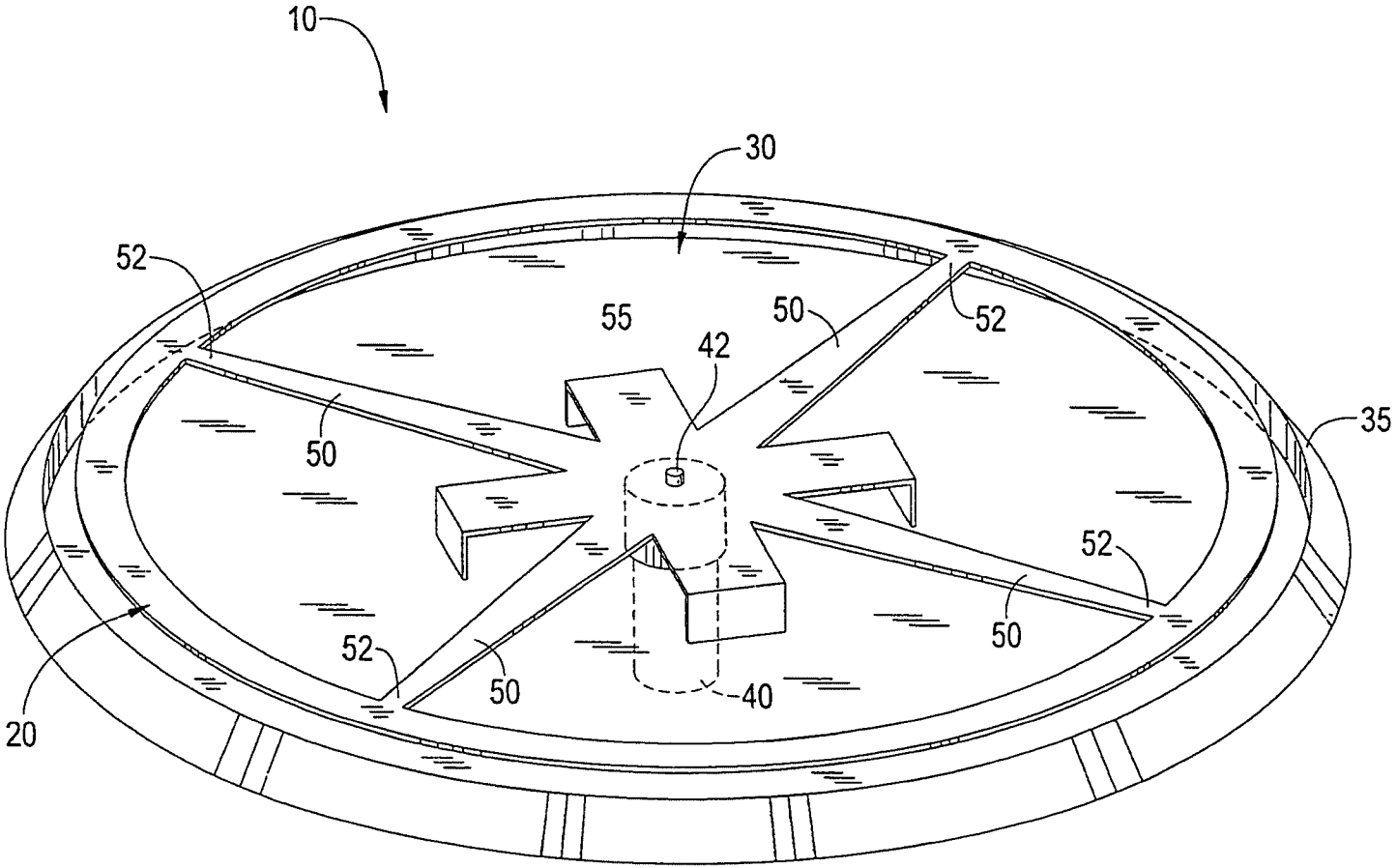
FIG. 3 is a perspective view of the embodiment of FIG. 1.

As shown in FIGS. 1-3, one embodiment of the present invention is an antenna 10, comprising a radiator 20, a ground plane 30, a feed 40, and a plurality of microstrips 50 extending from the ground plane 30 to the radiator 20, with the feed 40 coupled to the microstrips 50 at feed point 55 between the ground plane 30 and radiator 20. As shown more clearly in FIGS. 2-3, the radiator 20 and the ground plane 30 lie in parallel planes separated by a gap 15. The gap 15 may be filled with air or with a solid or semi-solid dielectric material. In a preferred embodiment, the radiator 20 is annular and the ground plane 30 is circular. The radiator 20 may be other regular or irregular shapes, but for improved omnidirectional performance, it should be a symmetrical shape, such as circular or polygonal, with a circular shape providing optimal performance. The shape of the ground plane 30 preferably corresponds to that of the radiator 20. The perimeter of the ground plane 30 preferably extends beyond that of the radiator 20 by a distance that is equal to or greater than the width of the gap 15.

The outer ends 52 of the microstrips 50 are coupled to the radiator 20 at drive points 25. The microstrips 50 are coupled to the ground plane 30 at their inner end 54. The microstrips 50 are preferably coplanar with the radiator 20 through a substantial portion of their length, from the outer end 52 to a bend 53, where the microstrip turns downward across the gap 15 to meet the ground plane 30 at proximal end 54. As shown, the microstrips 50 may be tapered such that they become progressively narrower from the area near the coupling with the feed 40 to outer end 52. As discussed below, in a preferred embodiment, the number of microstrips is determined according to the dimensions of the radiator 20 and resonant wavelength of the antenna in order to drive the radiator 20 substantially in phase. In one embodiment, the radiator 20 and microstrips 50 are stamped from a single sheet of metal, and the bend 53 is formed simply by bending or crimping the microstrip 50 a distance from its inner end 54 that corresponds to the desired width of the gap 15 separating the ground plane 30 from the radiator 20.

The feed 40 is preferably a standard connector allowing coupling of the antenna 10 to a standard coaxial cable. That is, the feed 40 comprises a central conductor 42 carrying the input signal, which is coupled to the microstrips 50 at feed point 55, and an outer sheath of conductors 44 for the return signal path coupled to the ground plane 30. The central and outer conductors are separated by an insulator and constructed as is known by those of ordinary skill in the art. While the feed 40 is shown as being a standard coaxial feed, any other connector suitable for carrying a signal from an input source to the antenna 10 may be used, including hard wired connections directly to the feed point 40 and ground plane 30.

As with any antenna, the antenna 10 according to embodiments of the present invention has a resonant frequency $f_r$ that is a function of the materials and structure of the device. Certain dimensions of antennas are often expressed in terms of wavelength λ at the resonant frequency; for example, a quarter-wave dipole antenna refers to a dipole antenna with a length that is one-fourth as long as the wavelength λ of the signal propagated at the resonant frequency $f_r$. In a preferred embodiment, the length of each microstrip (from the inner end 54 to the bend 53 to the feed point 55, and on to the outer end 52) is approximately ¼ λ. The design of the antenna 10 allows for the microstrips 50 to extend through the feed point 55 at the center of the radiator 20 and then down to the ground plane 20. As a result, the distance from feed point 55 (at the center of the radiator 20, in a preferred embodiment) to the outer end 52 of the microstrip is less than ¼ λ, and thus the radiator has a radius less than ¼ λ while achieving the performance of a full ¼λ antenna. The size of the antenna is effectively reduced by the length of that portion of the microstrips 50 from the feed point 55 to the bend 53. Satisfactory performance characteristics are achieved with the gap 15 between the ground plane 30 and the radiator 20 being approximately 1/10 λ. Embodiments of the present invention provide the performance of a half-wave dipole at one-fifth the height.

According to one embodiment of the present invention, the placement of the feed point 55 relative to the length of microstrips 50 allows a lower input impedance of the feed 40 to be leveraged to match a higher load impedance of the radiator 20. Specifically, the ratio of the length of the microstrip 50 (from outer end 52 to the bend 53 and down to inner end 54, defined as $L_1$) to the distance from inner end 54 up to the bend 53 and to feed point 55 (defined as $L_2$) is directly proportional to the ratio of the load impedance of the radiator 20 ($R_L$) to the input impedance at the feed point ($R_I$):

$$\frac{L_1}{L_2} \propto \frac{R_L}{R_I}$$

Thus, if the feed point 55 is placed 1/10 of the length $L_1$ from the inner end 54, then a 10Ω input impedance at feed 40 will be leveraged to match the impedance of a radiator 20 having a 100Ω load impedance. If, using a more typical example, the radiator has a load impedance of 250Ω and the input impedance is 50Ω (typical of co-ax connection), then the ratio of $L_1$ to $L_2$ should be 5:1. The tapering of the microstrips 50, discussed above, aids in matching the impedance of the feed 40 to the radiator 20.

As shown in FIGS. 1-3, the antenna 10 comprises a plurality of microstrips 50 connecting the radiator 20 to the ground plane 30, with each coupled to the single feed 40. Thus, a simple single ended drive may be used to drive the antenna 10 from feed 40 through each of the microstrips 50 simultaneously. It is desirable that the signal driven on radiator 20 be substantially in phase along the entirety of the radiator 20. To do so, the drive points 25 at which the microstrips 50 connect to the radiator 20 should be close enough together such that substantial phase variances do not develop between drive points. In a preferred embodiment, with each microstrip being about ¼ λ in length, the distance between adjacent drive points 25 should be within about ¼ λ, in order to drive the radiator 20 substantially in phase throughout its circumference. Thus, in such a design, six microstrips will provide optimum transmission characteristics.

Figure 4A:
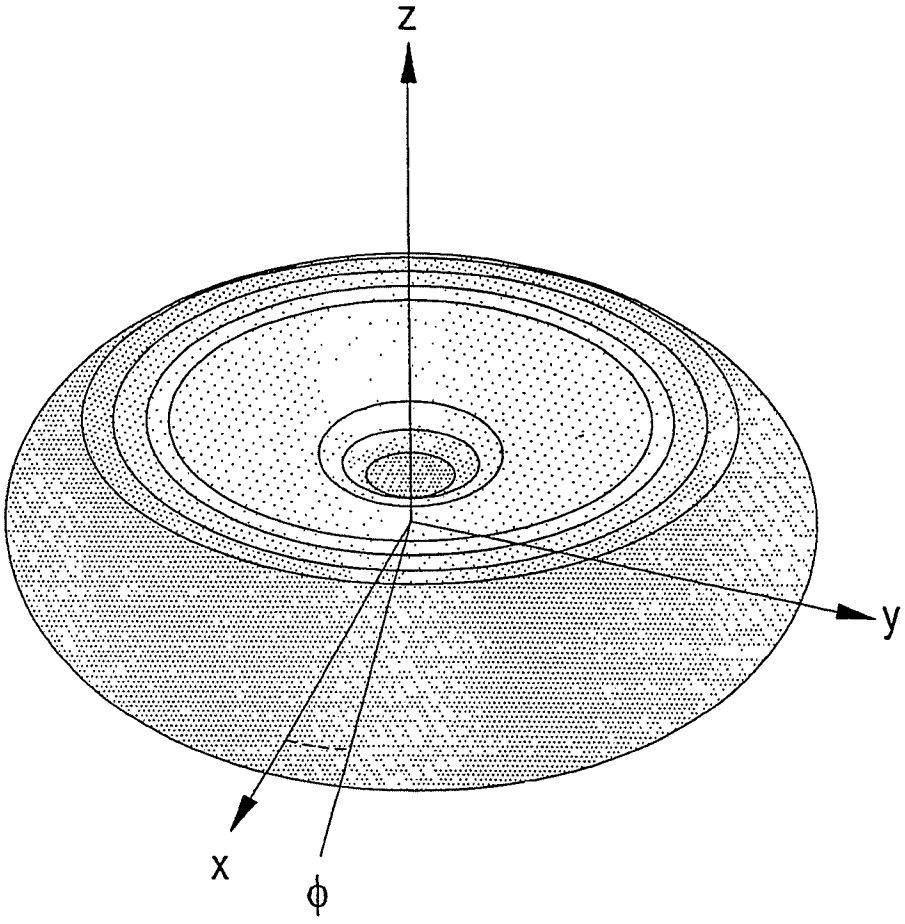
FIG. 4A is a perspective view of the power distribution of the radiation pattern of the embodiment of FIG. 1.

With the entirety of the radiator driven substantially in phase, an electromagnetic signal propagates uniformly from the radiator, with its power oriented primarily radially, rather than axially, with respect to the radiator, as shown in FIG. 4A. The power distribution of the signal is approximately toroidal in shape, with its peak power found at a distance D and at an elevation angle (ID from horizontal. This profile is suitable for transmitting to terrestrially based receivers, such as those located on telephone or power poles, buildings, and the like. Power is not wasted in such applications by being transmitted axially, or vertically, from the radiator 20.

Figure 4B:
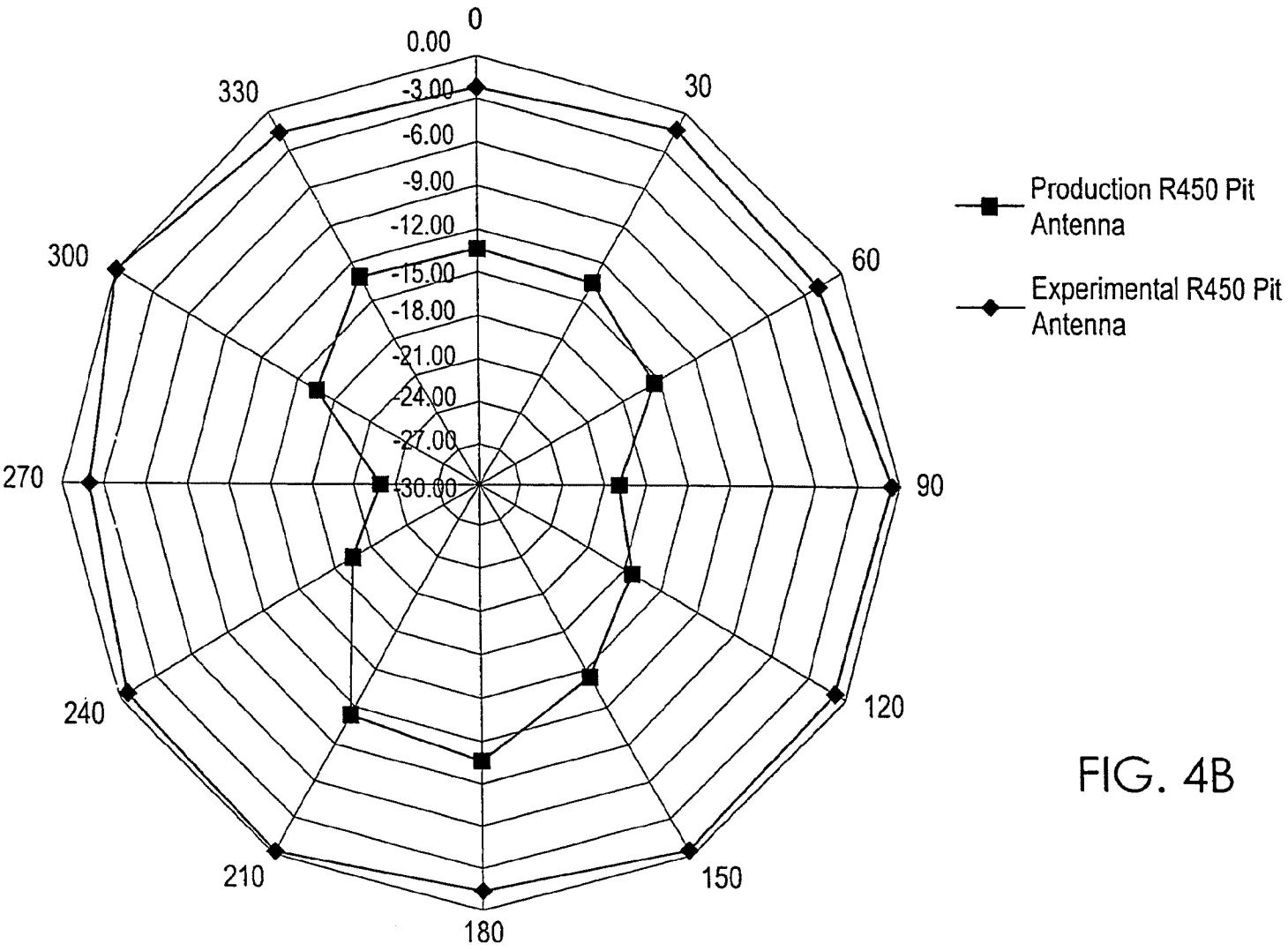
FIG. 4B is a top view of the power distribution of the radiation pattern of the embodiment of FIG. 1.

Embodiments of the present invention therefore find application in antennas in which size and footprint are important, and in which the targeted receivers of the antenna's signal are displaced substantially horizontally, rather than vertically, from the antenna. The antenna is flat (about 1/10 λ thick) and less than ½ λ in diameter. One exemplary application is its use as a pit antenna in an automated water metering system. Water meters are often located in a small depression, or pit, in the yard of the premises. The meter may be equipped with a meter interface unit (MIU) that automatically records the meter readings and transmits them to a collecting device located on a telephone or power pole in the vicinity. One such collector may service thousands of MIUs. Because the MIUs are located at or near ground level, and the collector is located at a relatively low angle Φ relative to horizontal from the MIUs, and antenna having the power distribution characteristics of antenna 10, as shown in FIG. 4A-B, is advantageous. Further, the compact size and flat shape of the antenna 10 allows it to be integrated into the lid of the meter or otherwise fitted safely and securely into the meter pit.

FIGS. 1-3 illustrate a feature of an alternative embodiment of the present invention. The alternative embodiment includes an annular collar 35 around the periphery of the ground plane 30. The collar 35 is optional and may be added to increase the structural integrity of the antenna 10. In a preferred embodiment, the collar 35 is wedge-shaped in cross section, as shown in FIG. 2, and extends at least as high as gap 15, such that the top of the collar 35 is coplanar with the radiator 20 or higher. The distance 37 from the outer edge of the radiator 20 to the inner edge of the collar 20 is preferably greater than the height of the gap 15, to prevent the collar 35 from degrading the performance characteristics of the antenna 10. The collar 20 serves to make the antenna 10 rugged and structurally resistant to side forces, as well as forces from above that are delivered by an object larger than the diameter of the antenna. The collar 20 is rigid and preferably made of a solid material. This structure may protect the antenna 100 from being bent or broken if stepped on by a person, or even if run over by a vehicle. As long as the person's shoe or the vehicle tire spans the collar 20 from one side to the other, the antenna 100 is protected as the collar supports the person or vehicle's weight, rather than the radiator 20.

In a preferred embodiment, the antenna 10 was designed to resonate at 460 Mhz. Four microstrips 50 were used, as shown in FIGS. 1-3. A small amount of ripple in the voltage driven signal was measured from point to point along the radiator 20, but at approximately one meter away the power of the propagated signal was substantially in phase in all directions from the radiator 20, such that the ripple was immaterial. The uniformity of phase could be improved at the radiator 20 by using six microstrips; however, given the uniformity measured just one meter out from the radiator using four microstrips, it was determined that using six microstrips was not necessary.

Figure 5:
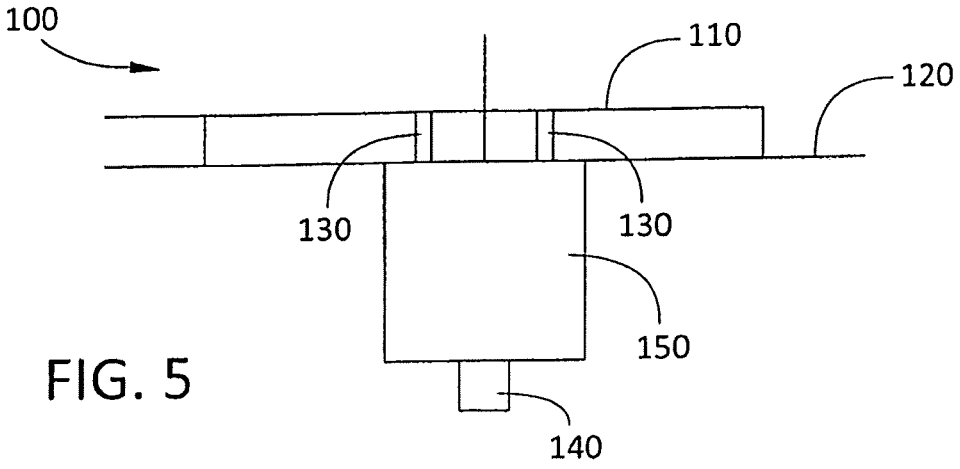
FIG. 5 is a side view of another embodiment of the present invention, comprising a quarter-wave choke around a coaxial feed line beneath the ground plane.
Figure 6:
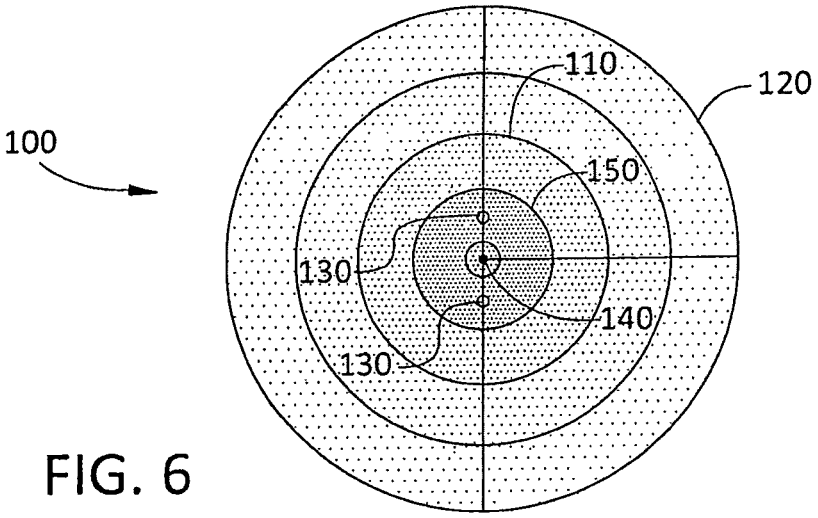
FIG. 6 is a top view of the embodiment of FIG. 5.
Figure 7:
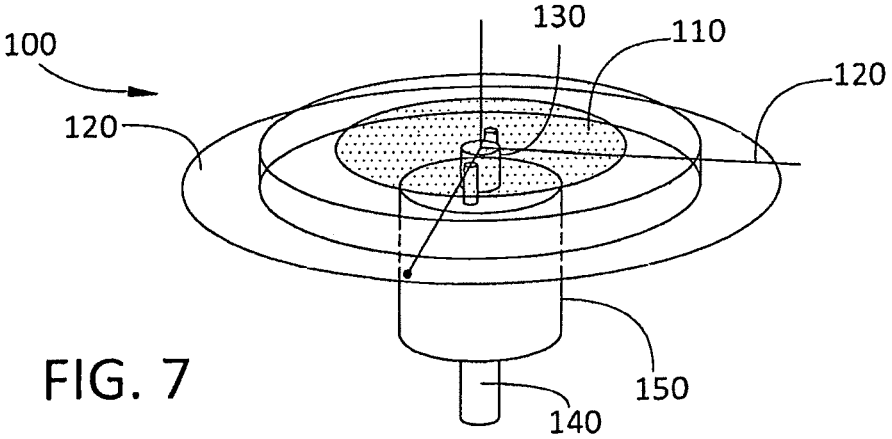
FIG. 7 is a perspective view of the embodiment of FIG. 6.

Another embodiment of the present invention comprises a cylindrical choke approximately one-quarter wavelength in length, placed under the ground plane of an antenna having a radiator over a ground plane. FIGS. 5-7 illustrate an exemplary embodiment of a center driven circular plate antenna 100 having a circular radiator 110, approximately one-fourth wavelength in diameter in one embodiment, over a ground plane 120. The radiator 110 is resonated by two to four or more inductive pins 130 with a diameter and location chosen to achieve resonance at a predetermined frequency and drive impedance, as is known in the art. In one embodiment, the ground plane 120 is substantially larger than the radiator 110, which substantially reduces the effects of objects near the antenna 110. The antenna 110 may be fed by a coax feed 140. In this embodiment, the central conductor of the feed 140 connects to the radiator 110, and the outer sheath connects to the ground plane 120. A cylindrical choke 150 surrounds the feed 140 just below the ground plane 120. The choke 150 comprises a thin metal cylinder and is connected to the ground plane 120. The choke 150 may or may not be filled with a high dielectric constant material for size reduction. The choke 150 is approximately one-quarter wavelength (¼ λ) of the resonant frequency of the antenna 100 in length.

Figure 8A:
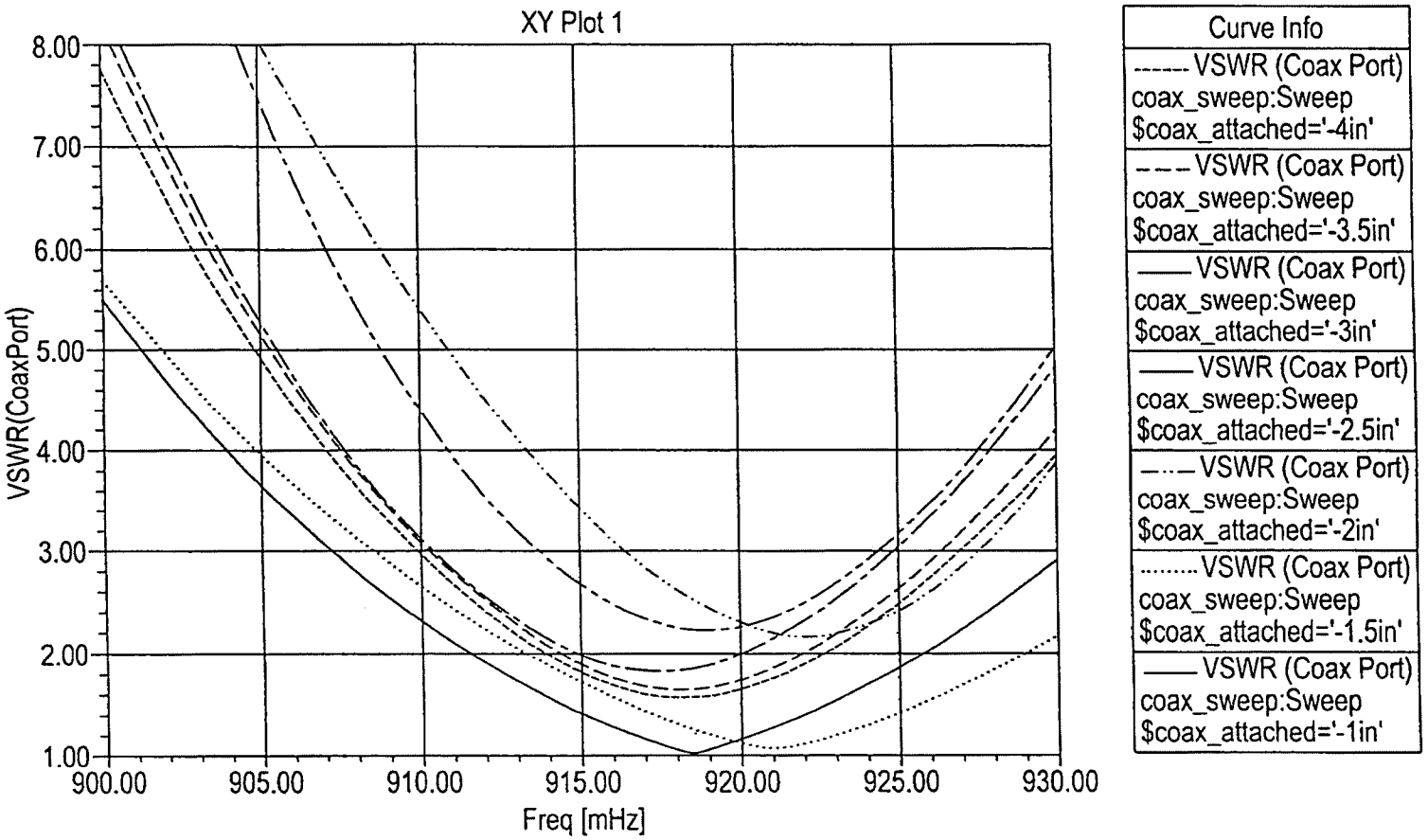
FIG. 8A-B are exemplary charts for an antenna showing VWSR amplitude versus frequency from coax feeds of one to four inches with (FIG. 8B) and without (FIG. 8A) an embodiment of the antenna choke of the present invention.
Figure 8B:
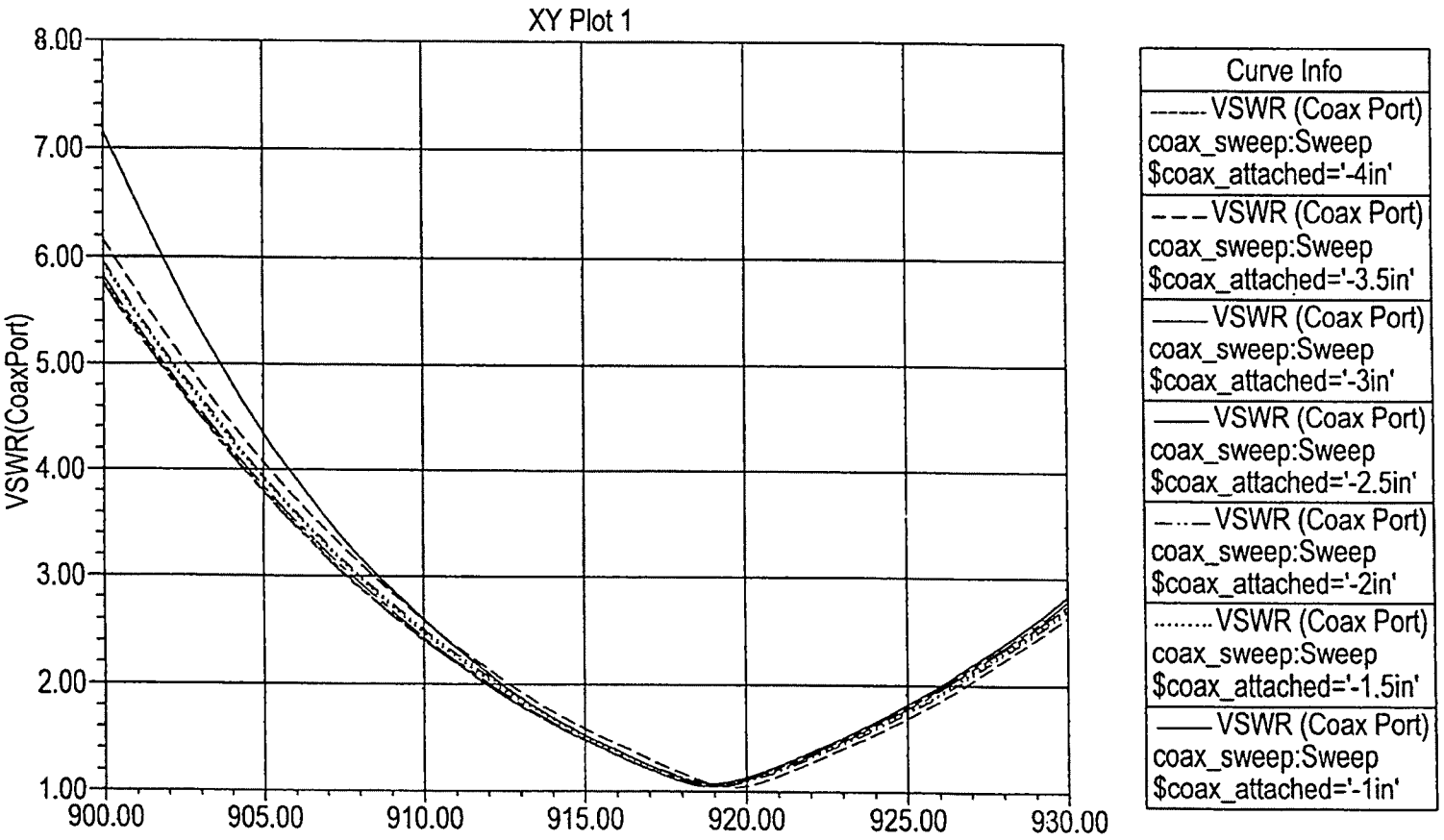
Figure 9A:
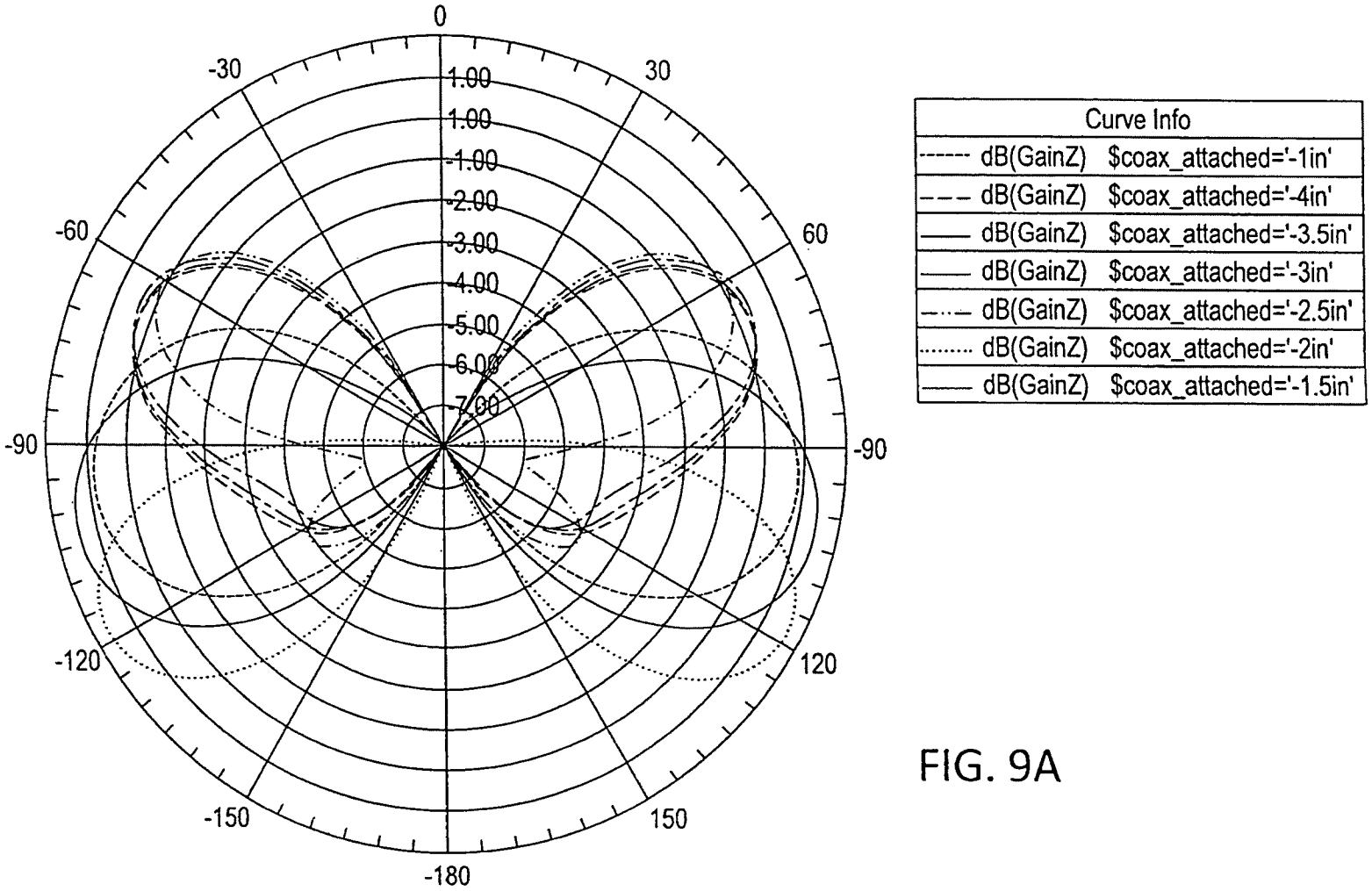
FIG. 9A-B are exemplary charts for the antenna of FIG. 8 showing radiation patterns with (FIG. 9B) and without (FIG. 9A) an embodiment of the antenna choke of the present invention.
Figure 9B:
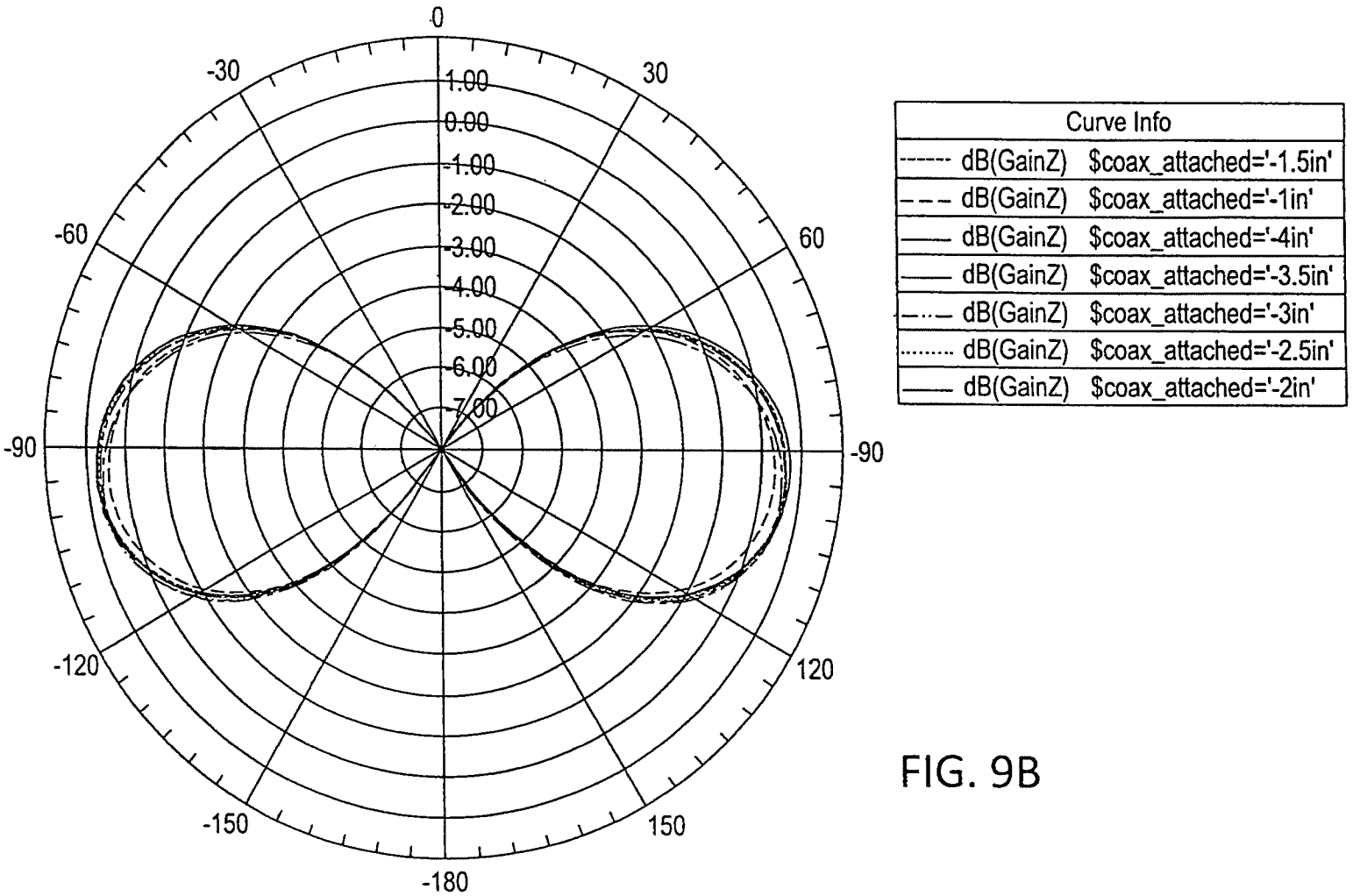

FIG. 8A-B are exemplary charts for an antenna showing VWSR amplitude versus frequency from coax feeds of one to four inches with (FIG. 8B) and without (FIG. 8A) an embodiment of the choke 150. As shown in FIGS. 8A-B, the VWSR is much more consistent when the choke 150 is used and nearly eliminates the effects of cable dress on antenna performance. FIG. 9A-B are exemplary charts for the antenna of FIG. 8 showing radiation patterns with (FIG. 9B) and without (FIG. 9A) an embodiment of the antenna choke of the present invention. Likewise, the choke 150 substantially increased the available energy above the ground (where the antenna is mounted in at ground level, or slightly underground such as in a pit of a water meter) and substantially eliminates the effects of cable dress on variation in radiation pattern.

A quarter-wavelength choke of this embodiment of the present invention may be used with any antenna having a radiator over a ground plane, fed by a coax feed line, including the antenna 10 of FIG. 1.

Although the present invention has been described and shown with reference to certain preferred embodiments thereof, other embodiments are possible. The foregoing description is therefore considered in all respects to be illustrative and not restrictive. Therefore, the present invention should be defined with reference to the claims and their equivalents, and the spirit and scope of the claims should not be limited to the description of the preferred embodiments contained herein.

What is claimed is:

1. A device comprising an antenna comprising a radiator having a resonant frequency and a ground plane;

a substantially cylindrical choke having a height that is approximately one-fourth the wavelength of said resonant frequency and a proximal end and a distal end;

a feed signal carrier passing through said choke defining a space between said carrier and said choke, said carrier comprising a first conductor having a proximal end electrically coupled to said radiator and a second conductor having a proximal end electrically coupled to said ground plane;

wherein said ground plane is positioned between said choke and said radiator, the proximal end of said choke electrically coupled to said ground plane.

2. The device of claim 1, wherein said feed signal carrier is a coaxial cable, and said first conductor is a central axial member of said coaxial cable, and said second conductor is a sheath surrounding and coaxial with said first conductor.

3. The device of claim 2, wherein the radiator is substantially circular in shape.

4. The device of claim 3, wherein the ground plane is larger than the radiator.

5. The device of claim 1, wherein the distal end of said choke is open.

6. The device of claim 5, wherein the space between said carrier and said choke is at least partially filled with a dielectric material.

7. The device of claim 1, wherein the antenna is a patch antenna.

8. The device of claim 1, further comprising a meter interface, wherein the distal end of said first conductor and the distal end of said second conductor are electrically coupled to said meter interface unit.

9. The device of claim 8, wherein the antenna is a patch antenna.

10. The device of claim 9, wherein said feed signal carrier is a coaxial cable, and said first conductor is a central axial member of said coaxial cable, and said second conductor is a sheath surrounding and coaxial with said first conductor.

11. The device of claim 10, wherein the distal end of said choke is open.

12. The device of claim 11, wherein the space between said carrier and said choke is at least partially filled with a dielectric material.

13. In a system comprising an antenna comprising a radiator having a resonant frequency and a ground plane fed by a coaxial cable, a choke comprising:

a substantially cylindrical member having a height that is approximately one-fourth the wavelength of said resonant frequency and a proximal end and a distal end, said proximal end being electrically coupled to said ground plane with said ground plane being positioned between said cylindrical member and said radiator, and wherein the distal end of said choke is open.

14. The device of claim 13, wherein there is a space between said cable and said choke, said space at least partially filled with a dielectric material.

15. A method of reducing interference from a feed cable to an antenna comprising a radiator having a resonant frequency and a ground plane, said method comprising:

passing said feed cable through a substantially cylindrical choke, defining a space between said cable and said choke, wherein said choke has a height that is approximately one-fourth the wavelength of said resonant frequency and a proximal end and a distal end;

positioning said ground plane between said choke and said radiator;

electrically coupling said feed cable to said antenna; and electrically coupling the proximal end of said choke to said ground plane.

16. The method of claim 15, further comprising least partially filling the space between said cable and said choke is with a dielectric material.

17. A device comprising a water meter coupled to a meter interface unit, said meter interface unit operable to record readings from said meter, an antenna comprising a radiator having a resonant frequency and a ground plane, a substantially cylindrical choke having a height that is approximately one-fourth the wavelength of said resonant frequency and a proximal end and a distal end, wherein said ground plane is positioned between said choke and said radiator, the proximal end of said choke electrically coupled to said ground plane;

a coaxial cable electrically coupling said meter interface unit to said antenna, said cable passing through said choke;

wherein said water meter, meter interface unit, antenna, choke, and cable are adapted to fit into a pit at or near ground level.

18. The device of claim 17, wherein the antenna is a patch antenna.

19. The device of claim 17, wherein the distal end of said choke is open.

20. The device of claim 19, wherein the space between said carrier and said choke is at least partially filled with a dielectric material.

* * * * *